US010044173B2

(12) United States Patent
Kyuno

(10) Patent No.: US 10,044,173 B2
(45) Date of Patent: Aug. 7, 2018

(54) METHOD OF MANUFACTURING SPARK PLUG

(71) Applicant: NGK SPARK PLUG CO., LTD., Nagoya-shi, Aichi (JP)

(72) Inventor: Jiro Kyuno, Kiyosu (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/582,912

(22) Filed: May 1, 2017

(65) Prior Publication Data

US 2017/0324224 A1 Nov. 9, 2017

(30) Foreign Application Priority Data

May 9, 2016 (JP) ..... 2016-093657

(51) Int. Cl.
*H01T 21/02* (2006.01)
*H01T 13/58* (2011.01)
*H01J 9/00* (2006.01)

(52) U.S. Cl.
CPC ..... *H01T 21/02* (2013.01); *H01T 13/58* (2013.01)

(58) Field of Classification Search
None
See application file for complete search history.

(56) References Cited

U.S. PATENT DOCUMENTS 6,790,113 B1 9/2004 Fujita
2009/0007618 A1* 1/2009 Ohashi ..... B21H 3/042 72/88

FOREIGN PATENT DOCUMENTS

JP 2000-164320 A 6/2000
JP 2003-297525 * 10/2003
JP 2003-297525 A 10/2003

OTHER PUBLICATIONS

Japan Patent Office, Office Action (Notification of Reasons for Refusal) issued in corresponding Application No. JP 2016-093657, dated Mar. 27, 2018.

* cited by examiner

*Primary Examiner* — Ashok Patel
(74) *Attorney, Agent, or Firm* — Stites & Harbison, PLLC; Jeffrey A. Haeberlin; James R. Hayne

(57) ABSTRACT

A method of manufacturing a spark plug including a cylindrical tubular metallic shell having a screw portion on an outer surface thereof and a ground electrode attached to an end surface at one end of the metallic shell in the direction of the center axis thereof comprises a measurement step of measuring a surface of the screw portion which passes through a measurement region located at a predetermined position in the direction of the center axis, while rotating the metallic shell about the center axis thereof; an attachment position calculation step of calculating, on the basis of information obtained in the measurement step, an attachment position at which the ground electrode is attached to the end surface; and a joining step of joining the ground electrode to the end surface at the attachment position, wherein the measurement step includes a step of measuring a displacement of the surface of the screw portion by using a non-contact-type displacement sensor.

6 Claims, 8 Drawing Sheets

METHOD OF MANUFACTURING SPARK PLUG

CROSS REFERENCE TO RELATED APPLICATION

The present application claims priority to Japanese Patent Application No. 2016-093657, which was filed on May 9, 2016, the disclosure of which is herein incorporated by reference in its entirety.

BACKGROUND OF THE INVENTION

Field of the Invention

The present invention relates to a method of manufacturing a spark plug.

Description of Related Art

A spark plug is screwed into and fixed to a cylinder head of an engine, whereby the spark plug is disposed on the engine. Therefore, a screw portion is formed on the outer surface of a metal is shell of a spark plug. In a state in which a spark plug is disposed on an engine, the orientation of the ground electrode of the spark plug disclosed in a combustion chamber of the engine tends to affect the ignition of an air mixture within the combustion chamber. The attachment position of the ground electrode on the spark plug determines the direction of the ground electrode of the spark plug disposed in the combustion chamber of the engine.

RELATED ART DOCUMENT

Patent Document 1 is Japanese Patent Application Laid-Open (kokai) No. 2003-297525.

BRIEF SUMMARY OF THE INVENTION

In the spark plug manufacturing method disclosed in Patent Document 1, the attachment position of the ground electrode of a spark plug is determined on the basis of an image obtained by photographing the surface of a screw portion formed on the outer surface of the metallic shell of the spark plug. In such a spark plug manufacturing method, the screw portion whose surface is not flat is photographed by a camera. Therefore, poor focusing may result in the blurred shape of the photographed screw portion, and may produce a variation in the attachment position of the ground electrode. Accordingly, there has been desire for a technique of allowing a ground electrode to be accurately attached to a predetermined position of a spark plug by restricting the production of a variation in the attachment position of the ground electrode.

The present invention has been accomplished in order to solve at least partially the above-mentioned problem, and can be realized as the following modes.

(1) According to one mode of the present invention, a method of manufacturing a spark plug is provided. This spark plug manufacturing method is used for manufacturing a spark plug including a cylindrical tubular metallic shell having a screw portion on an outer surface of the metallic shell and a ground electrode attached to an end surface of the metallic shell located at one end in a direction of a center axis thereof. The spark plug manufacturing method comprises a measurement step of measuring a surface of the screw portion which passes through a measurement region located at a predetermined position in the direction of the center axis, while rotating the metallic shell about the center axis of the metallic shell; an attachment position calculation step of calculating, on the basis of information obtained in the measurement step, an attachment position at which the ground electrode is attached to the end surface (i.e., the attachment position is a position at which the ground electrode is to be attached to the end surface); and a joining step of joining the ground electrode to the end surface at the attachment position, wherein the measurement step includes a step of measuring a displacement of the surface of the screw portion by using a non-contact-type displacement sensor. According to this mode, the displacement or the surface of the screw portion is measured. Therefore, as compared with the case where the surface of the screw portion is photographed by a camera, it is possible to improve the accuracy in measuring the surface of the screw portion which serves as a reference for determination of the attachment position of the ground electrode. Since the attachment position of the ground electrode is prevented from varying, the operation of attaching the ground electrode to a predetermined position of the spark plug, can be performed accurately.

(2) The spark plug manufacturing method of the above-described mode may further comprise a position determination step of determining the measurement region on the basis of (i.e., based on) a position which is spaced from a reference position by a predetermined distance along, the direction of the center axis, the reference position being measured for each metallic shell (i.e., for "the" metallic shell, such that for "each" spark plug that is manufactured, a reference position is measured, which may vary from spark plug to spark plug) and being used as a reference on the metallic shell. In this case, the screw portion measurement range can be determined in consideration of a production-related variation of each metallic shell. Therefore, as compared with the case where the surface of the screw portion is measured while a fixed position is used as the measurement region without consideration of the production-related variation of each metallic shell, the accuracy of the measurement in the measurement step can be improved.

(3) in the spark plug manufacturing method of the above-described mode, in the attachment position calculation step, the attachment position may be calculated by using, as a reference, a projecting portion of the surface of the screw portion passing through the measurement region, the projecting portion projecting outward as viewed from the center axis. In this case, a characteristic portion of the surface of the screw portion is used as a reference for determination of the attachment position of the ground electrode. Therefore, the accuracy of the ground electrode attachment position can be improved further.

(4) In the spark plug manufacturing method of the above-described mode, in the attachment position calculation step, the attachment position may be calculated by using, as a reference, a recessed portion of the surface of the screw portion passing through the measurement region, the recessed portion being recessed inward as viewed from the center axis. In this case, a characteristic portion of the surface of the screw portion is used as a reference for determination of the attachment position of the ground electrode. Therefore, the accuracy of the ground electrode attachment position can be improved further.

The mode of the present invention is not limited to the spark plug manufacturing method, and the present invention can be applied to various modes, such as a spark plug manufacturing apparatus, a spark plug to be mounted on an internal combustion engine, an internal combustion engine system including the internal combustion engine, and a vehicle including the internal combustion engine system. Also, the present invention is not limited to the above-mentioned modes and can be implemented in various modes without departing from the scope of the present invention.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE INVENTION

A. First Embodiment

Figure 1:
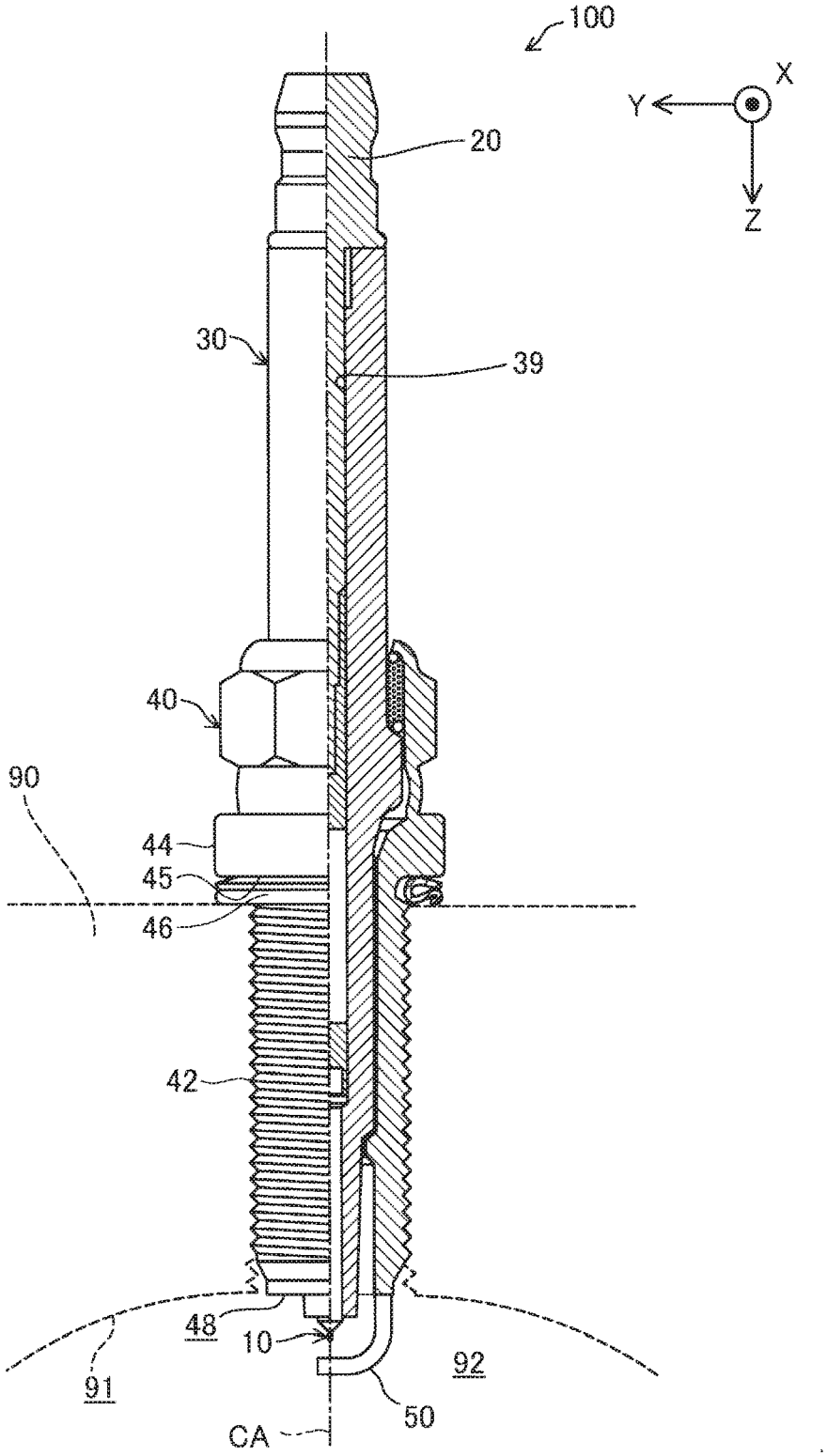
FIG. 1 is an explanatory view showing a partially sectioned spark plug.

A-1. Structure of Spark Plug:

FIG. 1 is an explanatory view showing a partially sectioned spark plug 100. In FIG. 1, an external shape of the spark plug 100 is shown on the left side of an axial line CA, which is the center axis of the spark plug 100, and a cross-sectional shape of the spark plug 100 is shown on the right side of the axial line CA. In the description of the present embodiment, the lower side of the spark plug 100 on the sheet of FIG. 1 will be referred to as the "forward end side," and the upper side of the spark plug 100 on the sheet of FIG. 1 will be referred to as the "rear end side." X, Y, and Z axes perpendicularly intersecting with one another are shown in FIG. 1. The X, Y, and Z axes of FIG. 1 correspond to the X, Y, and Z axes of other drawings. The axial line CA shown in FIG. 1 extends along the Z axis.

The spark plug 100 includes a center electrode 10, a metallic terminal 20, an insulator 30, a metallic shell 40, and a ground electrode 50. In the present embodiment, the axial line CA of the spark plug 100 also serves as the center axes of the center electrode 10, the metallic terminal 20, the insulator 30, and the metallic shell 40.

The spark plug 100 has, on the forward end side thereof, a spark discharge gap which is formed between the center electrode 10 and the ground electrode 50. The spark plug 100 is configured such that it can be attached to an internal combustion engine 90 in a state in which a forward end portion of the spark plug 100 having the spark discharge gap projects from an inner wall 91 of a combustion chamber 92. When a high voltage (e.g., 10,000 V to 30,000 V) is applied to the center electrode 10 of the spark plug 100 attached to the internal combustion engine 90, spark discharge is generated at the spark discharge gap. The spark discharge generated at the spark discharge gap realizes ignition of an air-fuel mixture within the combustion chamber 92.

The center electrode 10 is an electrode having electrical conductivity. The center electrode 10 has the shape of a rod extending in the direction of the axial line CA. The outer surface of the center electrode 10 is electrically insulated from the outside by the insulator 30. A forward end portion of the center electrode 10 projects from a forward end portion of the insulator 30. The metallic terminal 20 is a terminal for receiving the supply of electric power and is electrically connected to the center electrode 10.

The insulator 30 is a ceramic insulator which is electrically insulative. The insulator 30 has the shape of a tube extending along the axial line CA. In the present embodiment, the insulator 30 is formed by firing an insulating, ceramic material (e.g., alumina). The insulator 30 has an axial hole 39, which is a through-hole extending in the direction of the axial line CA. The center electrode 10 is held in the axial hole 39 of the insulator 30 to be located on the axial line CA and project from the forward end of the insulator 30.

The metallic shell 40 is a metallic member having electrical conductivity. The metallic shell 40 has the shape of a cylindrical tube which extends in the direction of the axial line CA. In the present embodiment, the metallic shell 40 is a nickel-plated tubular member formed of low-carbon steel. A screw portion 42 for attaching the spark plug 100 to the combustion chamber 92 of the internal combustion engine 90 is formed on the outer surface of a forward end portion of the metallic shell 40.

A flange portion 44 is formed on the rear end side of the screw portion 42. The flange portion 44 has a flange-like outer shape. In a process of manufacturing the spark plug 100, a gasket 46 is attached to a surface 45 of the flange portion. 44 which faces toward the positive side in the Z-axis direction. The gasket 46 is pressed against the internal combustion engine 90 by the flange portion 44 and establishes a seal between the spark plug 100 and the internal combustion engine 90, to thereby maintain the gastightness within the combustion chamber 92.

An annular end surface 48 extending along the X-Y plane is formed at the forward end of the metallic shell 40. The insulator 30, together with the center electrode 10, protrudes from the center of the end surface 48 toward the positive side of the Z-axis direction (forward end direction). The ground electrode 50 is joined to the end surface 48.

The ground electrode 50 is an electrode having electrical conductivity. The ground electrode 50 has a rod-like shape, and its one end is joined to the end surface 48 of the metallic shell 40. After extending toward the positive side of the Z-axis direction from the end surface 48 of the metallic shell 40, the ground electrode 50 is bent toward the axial line CA. In the present embodiment, the ground electrode 50 is formed of a nickel alloy which contains nickel (Ni) as a main component.

A2. Spark Plug Manufacturing Method

Figure 2:
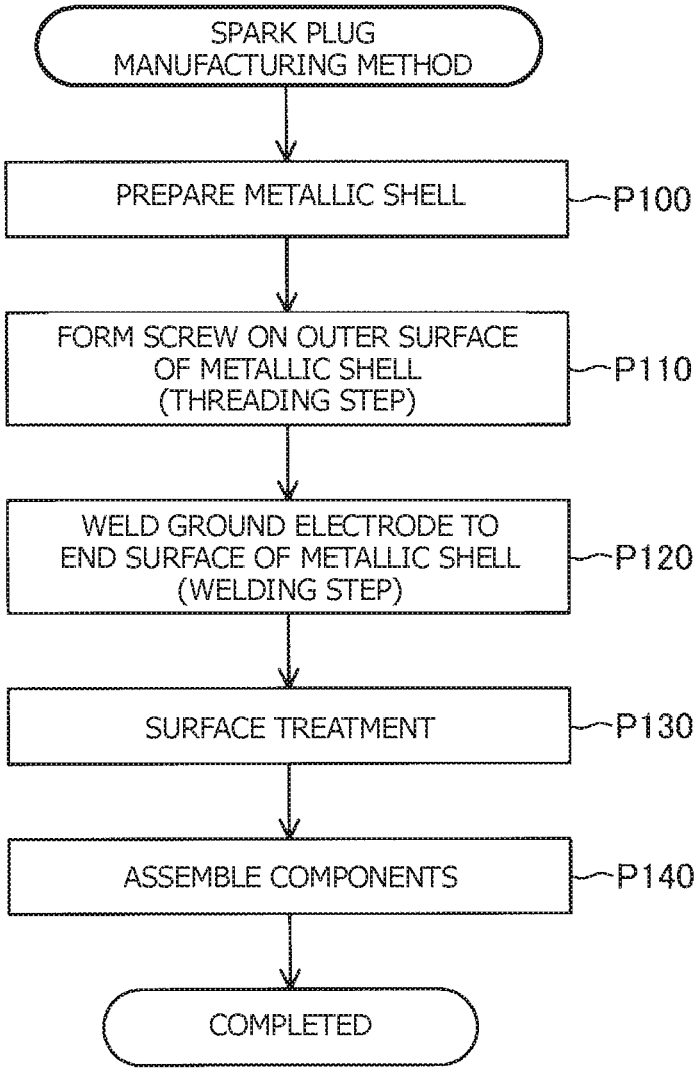
FIG. 2 is a flowchart showing a method of manufacturing the spark plug.

FIG. 2 is a flowchart showing a method of manufacturing the spark plug 100. When the spark plug 100 is to be manufactured, a manufacturer of the spark plug 100 prepares a metallic shell 40P which is an intermediate product of the metallic shell 40 (step P100). In the present embodiment, the metallic shell 40P is prepared through press work and cutting work. In the present embodiment, the screw portion 42 is not formed on the metallic shell 40P.

After the metallic shell 40P is prepared (step P100), a threading step is performed for the metallic shell 40P, whereby the screw portion 42 is formed on the outer surface of the metallic shell 40P (step P110). The threading step (step P110) is performed by mean rolling by a die. After the threading step (step P110), a welding step (step P120) is pet formed for the metallic shell 40P. The welding step (step P120) is a step of welding a ground electrode 50P (which an intermediate product of the ground electrode 50) to the end surface 48 of the metallic shell 40P. In the present embodiment, the ground electrode 50P is an un-bent straight rod-shaped member. The cross section of the ground electrode 50P taken perpendicular to the Z axial direction is a rectangular cross section.

After that, the metallic shell 40P is surface-treated (plated) (step P130). As a result the metallic shell 40 is completed.

After completion of the metallic shell 40 P130), other members (the center electrode 10, the metallic terminal 20, the insulator 30, etc.) are assembled into the metallic shell 40 (step P140). As a result, the spark plug 100 is completed. In the present embodiment, the ground electrode 50P is bent in the step in which the other members are assembled into the metallic shell 40 (step P140).

A3. Structure of Spark Plug Manufacturing Apparatus

Figure 3:
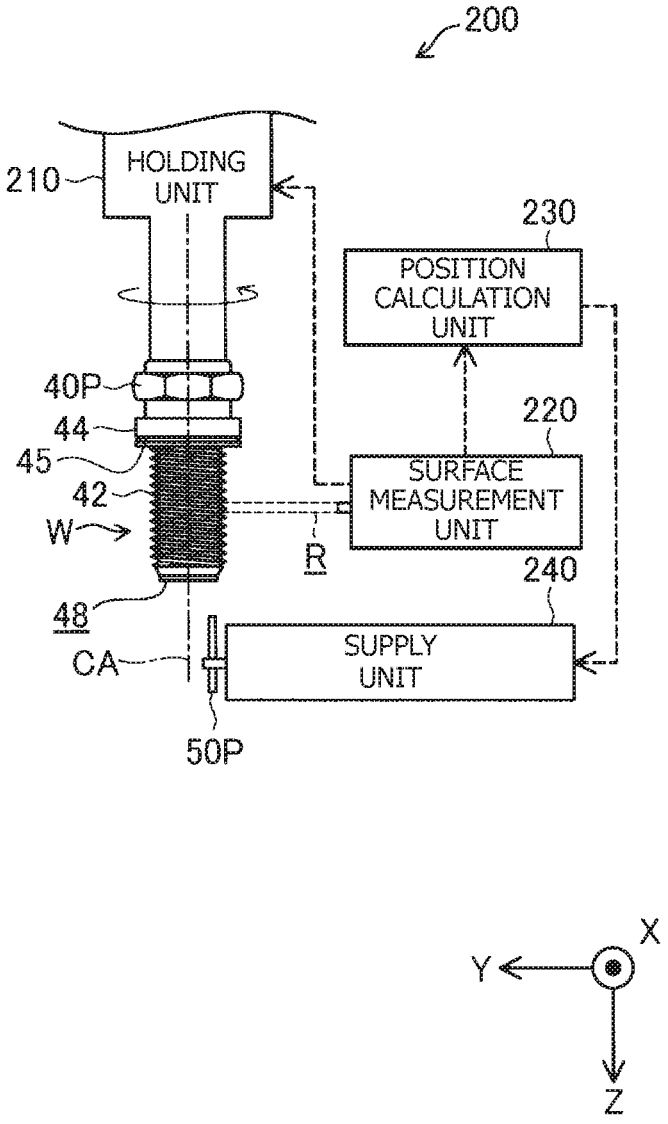
FIG. 3 is an explanatory view showing a spark plug manufacturing apparatus according to a first embodiment.

FIG. 3 is an explanatory view showing a spark plug manufacturing apparatus 200 of the present embodiment which is used in the welding step (step P120) which the ground electrode 50P is welded to the end surface 48 of the metallic shell 40P. The spark plug manufacturing apparatus 200 includes a holding unit 210, a surface measurement unit 220, a position calculation unit 230, and a supply unit 240.

Notably, in the present embodiment, the metallic shell 40P having the screw portion 42 which is formed on its outer surface by the threading step (step P110) will be referred to as a workpiece W.

The holding unit 210 holds the workpiece W. The holding unit 210 is inserted into the tubular metallic shell 40P extending in the direction of the axial line CA from the negative side of the Z axial direction, and holds the workpiece W. The holding unit 210 can rotate the held workpiece W about the axial line CA. When the workpiece W rotated, the position of the workpiece W in the Z axial direction does not change.

When the workpiece W is being rotated, the surface measurement unit 220 measures the displacement of the surface of the screw portion 42 which passes through a measurement region R located at a predetermined position in the Z axial direction. The width of the measurement region R in the Z axial direction is equal to or smaller than the pitch of the measured screw portion 42.

In the present embodiment, the surface measurement unit 220 forms the measurement region R by emitting a laser beam whose cross-sectional shape in the X-Z plane is a circular such that the laser beam propagates from the negative side of the Y axial direction toward the positive side thereof. The surface measurement unit 220 is a displacement sensor which measures, without contacting the screw portion 42, a change in the distance to the surface of the screw portion 42 passing through the measurement region R.

Figure 4:
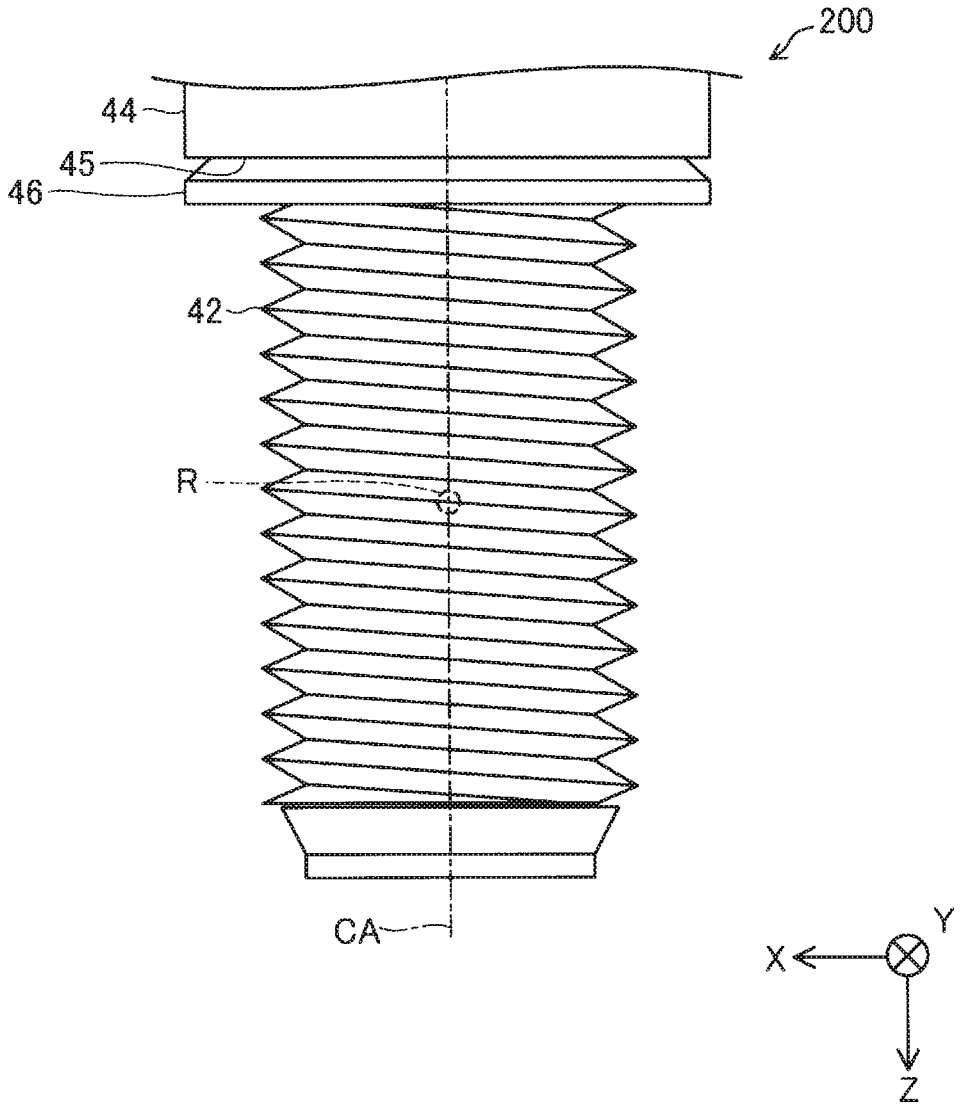
FIG. 4 is an explanatory view of a workpiece as viewed from the negative side of a Y-axis direction.

FIG. 4 is an explanatory view of the workpiece W held by the holding unit 210 as viewed from the negative side of the Y axial direction. The surface measurement unit 220 measures the distance to the surface of the screw portion 42 passing through the measurement region R, and obtains, as information A1, a phase-distance curve Ph1 which represents the relation between the measured distance and the phase angle of the holding unit at the time when the workpiece W is rotated.

In the present embodiment, a projecting portion. of the screw portion 42 which projects outward as viewed from the axial line CA is used as a reference for the determination of the attachment position of the ground. electrode 50P. Since the outwardly projecting projecting portion of the screw portion 42 is a characteristic portion on the surface of the screw portion 42, the accuracy of the attachment position of the ground electrode 50P can be improved.

Figure 5:
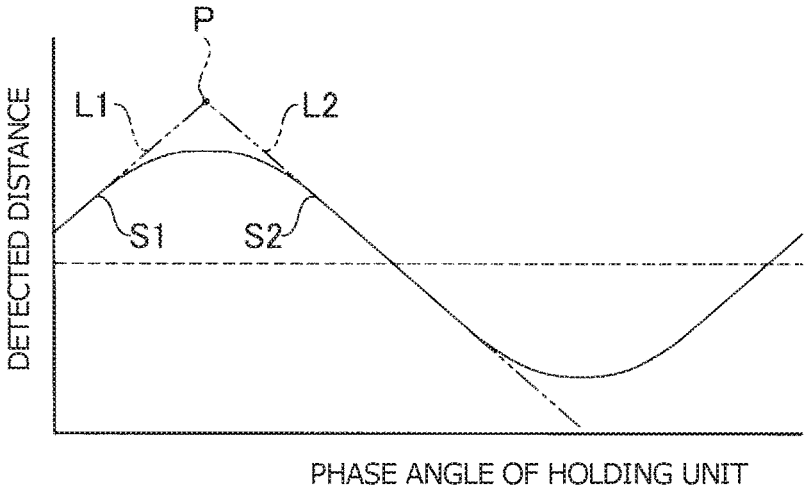
FIG. 5 is a graph showing a phase-distance curve which represents the relation between the measured distance and the phase angle of a holding unit at the time when the holding unit rotates the workpiece.

FIG. 5 is a graph showing a phase-distance curve Phi which represents the relation between the measured distance and the phase angle of the holding unit 210 at the time when the holding unit 210 rotates the workpiece W. The vertical axis of FIG. 5 shows the distance, measured by the surface measurement unit 220, between the surface measurement unit 220 and the surface of the screw portion 42 passing through the measurement region R. The horizontal axis of FIG. 5 shows the phase angle of rotation of the holding unit 210. Since the screw portion 42 is formed on the outer surface of the metallic shell 40P by means of rolling, the end of the outwardly projecting projecting portion of the screw portion 42 does not have a pointed shape but has a smooth shape.

In the present embodiment, "the outwardly projecting projecting portion of the screw portion 42" is defined as follows. Namely, "the outwardly projecting projecting portion of the screw portion 42" corresponds to the point P of intersection between imaginary extension lines L1 and L2 extending from slanted line segments S1 and S2 located between inflection points on the phase-distance curve Ph1. Notably, in the present embodiment, the angle between the extension lines L1 and L2 is 60 degrees.

When the surface measurement unit 220 obtains the phase-distance curve Ph1 for one revolution of the workpiece W after the rotation by the holding unit 210 has been started, a signal is output from the surface measurement unit 220 (shown in FIG. 3). Upon reception of the signal output from the surface measurement unit 220, the holding unit 210 stops its rotation, whereby the rotation of the workpiece W is stopped. At that time, the surface measurement unit 220 outputs a signal representing the information A1 to the position calculation unit 230 (shown in FIG. 3). On the basis of the signal output from the surface measurement unit 220 and representing the information A1, the position calculation unit 230 calculates the attachment position at which the ground electrode 50P is attached to the end surface 48.

Figure 6:
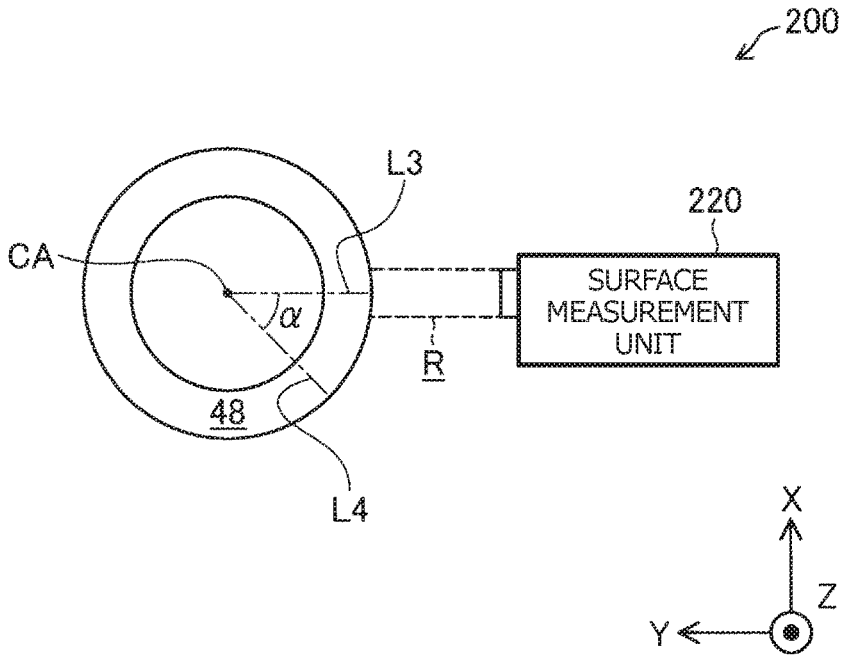
FIG. 6 is an explanatory view of a workpiece as viewed from the positive side of a Z-axis direction.

FIG. 6 is an explanatory view of the workpiece W as viewed from the positive side of the Z-axis direction. In the present embodiment, the posit on calculation unit 230 calculates, as the attachment position, a position on the end surface 48 determined as follows. FIG. 6 shows a state in which the point P is located at the center of the circular cross sect the measurement region R. A straight line extending along the Y-axis direction from the axial line CA toward the negative side of the Y-axis direction is defined as a straight line L3. A straight Line which extends from the axial line CA and slants toward the negative side of the X-axis direction an angle $\alpha$ respect to the straight line is defined as a straight line L4. A position on the end surface 48 through which the straight line L4 extends is calculated as the attachment position. The position calculation unit 230 outputs a signal representing the calculated attachment position to the supply unit 240 (shown in FIG. 3).

On the basis of the Signal representing the attachment position calculated the position calculation unit 230, the supply unit 240 supplies the ground electrode 50P to the attachment position from the positive side of the Z axial direction as viewed from the workpiece W (shown in FIG. 3). More specifically, the supply unit 240 supplies the ground electrode 50P to the attachment position which is a position at which the center axis of the ground electrode 50P, which is a rod-shaped member, overlaps the straight line L4 on the end surface 48. The ground electrode 50P supplied to the attachment position is laser-welded to the end surface 48 of the metallic shell 40P.

In the above-described embodiment, the displacement of the surface of the screw portion 42 is measured. Therefore, as compared with an embodiment in which the surface of the screw portion is photographed by a camera, it is possible to improve the accuracy in measuring the surface of the screw portion 42 which serves as a reference for determination of the attachment position of the ground electrode 50P. Since the attachment position of the ground electrode 50P is prevented from varying, the operation of attaching the ground electrode 50P to a predetermined position of the spark plug 100 can be performed accurately.

B. Second Embodiment

Figure 7:
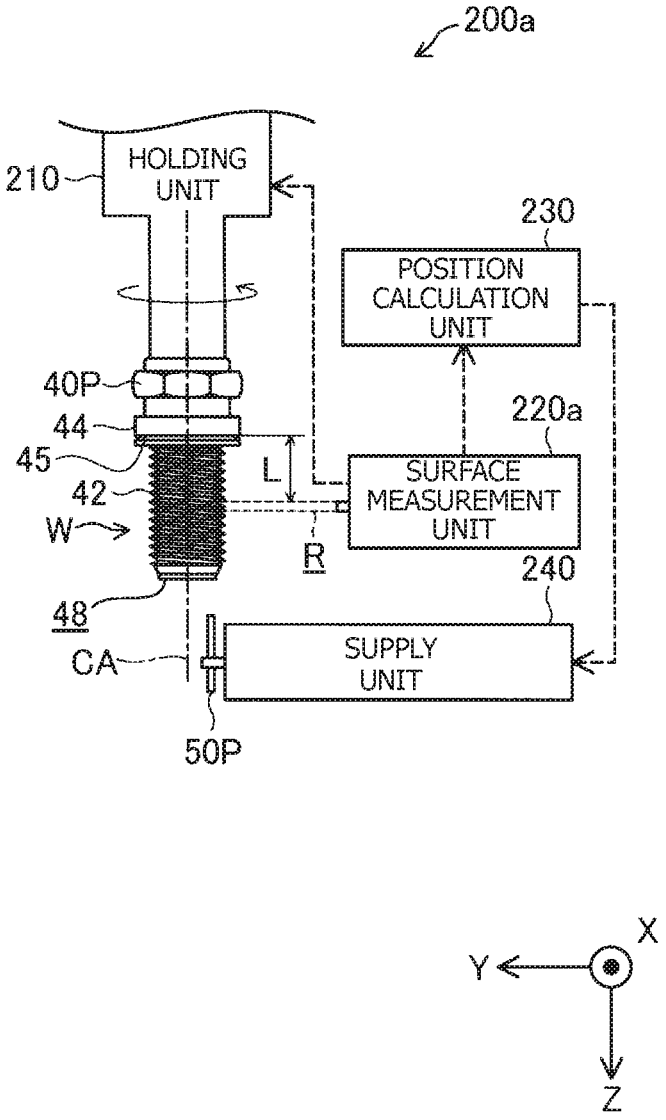
FIG. 7 is an explanatory view showing a spark plug manufacturing apparatus according to a second embodiment.

FIG. 7 is an explanatory view showing a spark plug manufacturing apparatus 200*a* according to a second embodiment. The structure of the spark plug manufacturing apparatus 200*a* is the same as that of the spark plug manufacturing apparatus 200 of the first embodiment except the point that the spark plug manufacturing apparatus 200*a* includes a surface measurement unit 220*a* different from the surface measurement unit 220 in the first embodiment.

The surface measurement unit 220*a*is configured to be movable in the Z axial direction. For each workpiece W, the surface measurement unit 220*a* measures the position of the surface 45 by moving toward the negative side of the Z axial direction. On the basis of the position of the surface 45 measured for each workpiece W, the surface measurement unit 220*a* determines, as the position of the measurement region R, a position which is spaced from the position of the surface 45 by a predetermined distance L along the Z axial direction. The above-mentioned step performed by the surface measurement unit 220*a* corresponds to the position determination step in the means for solving the problem.

Therefore, the measurement position of the screw portion 42 can be determined in consideration of a production-related variation of each metallic shell 40P. Therefore, as compared with an embodiment in which the surface of the screw portion 42 is measured while a fixed position is used as the measurement region R without consideration of the production-related variation of each metallic shell 40P, the accuracy of the measurement in the measurement step can be improved. The smaller the pitch of the screw portion 42, the greater the effectiveness of the spark plug manufacturing apparatus 200*a* which can determine the measurement position of the screw portion 42 in consideration of the production-related variation of each metallic shell 40P.

Figure 8:
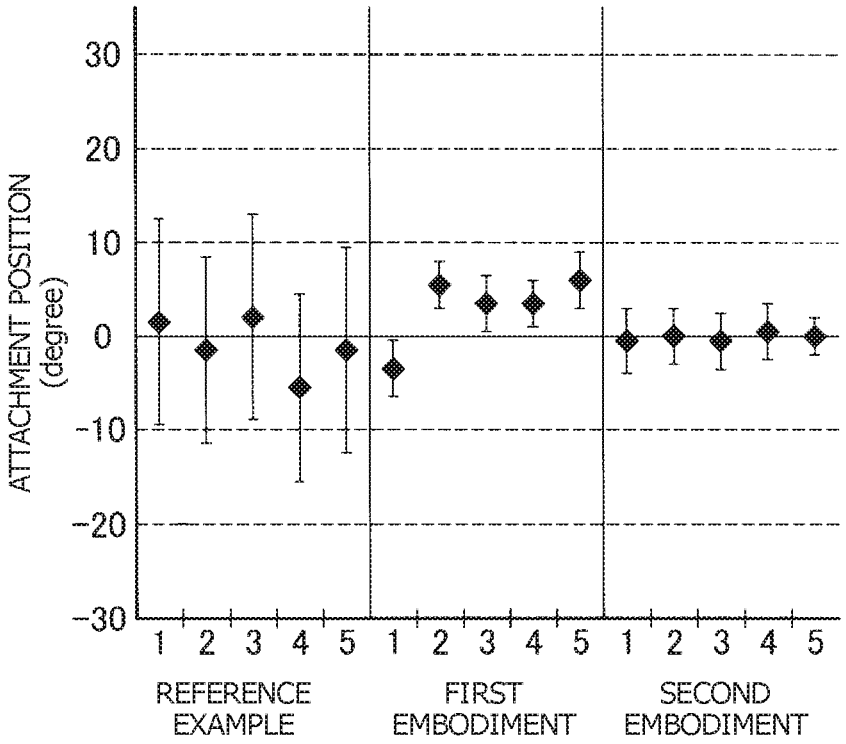
FIG. 8 is a graph showing differences between an ideal ground electrode attachment position and actual ground electrode attachment positions.

FIG. 8 is a graph showing differences between an attachment position of the ground electrode 50P which is ideal for ignition of an air-fuel mixture within the combustion chamber 92 and actual attachment positions of the ground electrode 50P. The vertical axis of FIG. 8 shows deviations from the ideal attachment position by an angle from the ideal attachment position (0).

A portion of the graph for a reference example shown along the horizontal axis thereof shows the attachment positions of the ground electrode 50P in the reference example in which the ground electrode 50P was attached through use of a spark plug manufacturing apparatus which determines the ground electrode attachment position on the basis of an image captured by a camera. A portion of the graph for the first embodiment shown along the horizontal axis thereof shows the attachment positions of the ground electrode 50P in the first embodiment in which the ground electrode 50P was attached through use of the spark plug manufacturing apparatus 200 of the first embodiment. A portion of the graph for the second embodiment shown along the horizontal axis thereof shows the attachment positions of the ground electrode 50P in the second embodiment in which the ground electrode 50P was attached through use of the spark plug manufacturing apparatus 200*a* of the second embodiment.

Each of the numerals provided along the horizontal axis shows a production lot of spark plugs for which the ground electrode 50P was attached through use of the respective spark plug manufacturing apparatus. In FIG. 8, the averaged attachment positions in each production lot is shown by a black square mark, and the variation among the attachment positions is shown by a vertical line extending, from the black square mark.

The followings were confirmed from the results shown in FIG. 8. As compared with the case where the spark plug manufacturing apparatus of the reference example is used, the variation decreased when the spark plug manufacturing apparatus 200 of the first embodiment was used. Namely, it was confirmed that the variation is decreased by using the information obtained through measurement of the surface of the screw portion 42 as a reference for determination of the attachment position of the ground electrode 50P, in contrast to the case where an image captured by a camera is used as a reference for determination of the attachment position of the ground electrode 50P.

In the case where the spark plug manufacturing apparatus 200*a* of the second embodiment was used, the actual attachment positions of the ground electrode 50P approached to zero to a greater degree, as compared with the case where the spark plug manufacturing apparatus 200 of the first embodiment was used. Namely, it was confirmed that when the position of the measurement region R is determined on the basis of the position of the surface 45 measured for each workpiece W, the deviations of the actual attachment positions of the ground electrode 50P from the ideal attachment position of the ground electrode 50P can be reduced.

C. Third Embodiment

Figure 9:
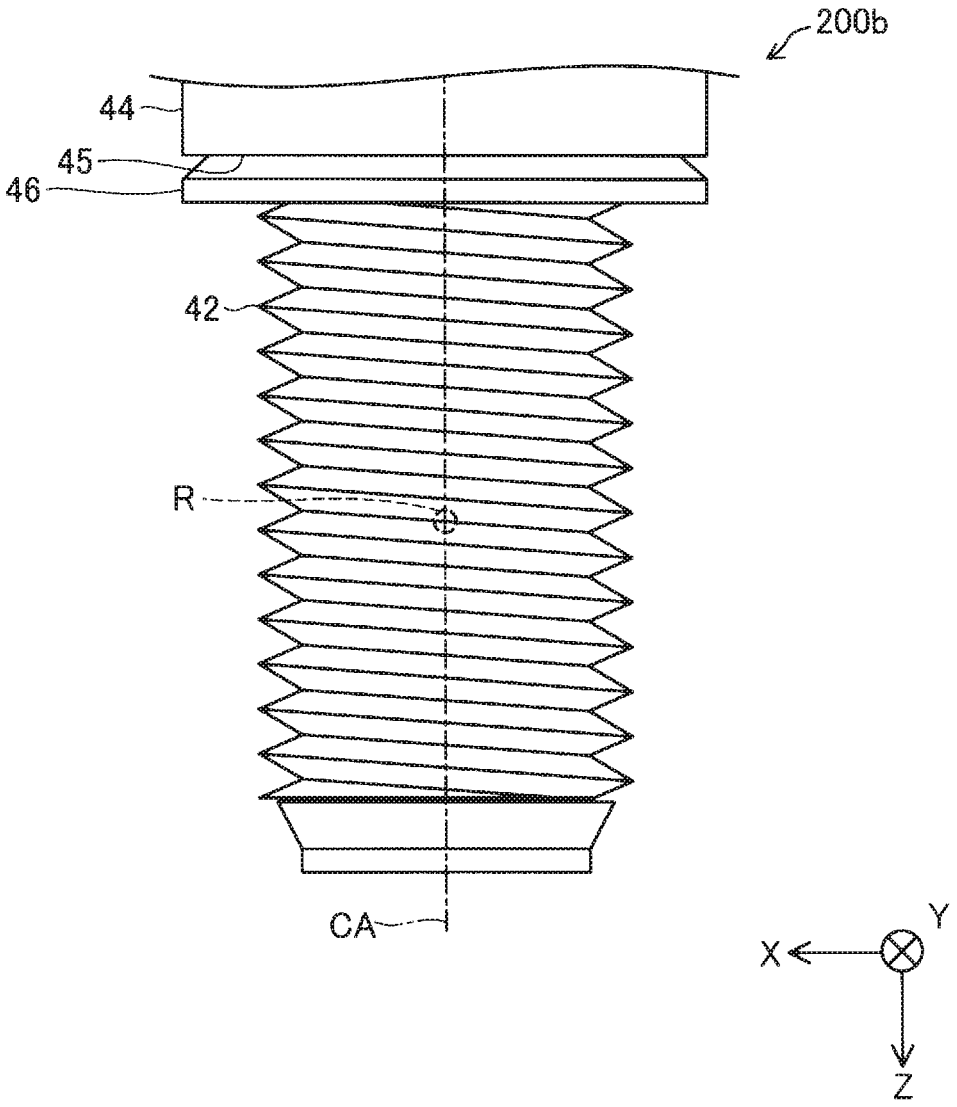
FIG. 9 is an explanatory view showing a state in which a workpiece is measured by a spark plug manufacturing apparatus according to a third embodiment.

FIG. 9 is an explanatory view showing a state in which the workpiece W is measured by a spark plug manufacturing apparatus 200*b* according to a third embodiment. In the third embodiment, a recessed portion of the screw portion 42 which is recessed inward as viewed from the axial line CA is used as a reference for determination of the attachment position of the ground electrode 50P. Since the inwardly recessed recessed portion of the screw portion 42 is a characteristic portion on the surface of the screw portion. 42, the accuracy of the attachment position of the ground electrode 50P can be improved.

D. Modifications

In the first embodiment, the position calculation. unit 230 outputs the signal representing the calculated attachment position to the supply unit 240. However, the present invention is not limited thereto. For example, the position calculation unit 230 may output the signal representing the calculated attachment position to the holding unit 210. In this case, the holding unit. 210 rotates the workpiece W about the axial line CA such that the attachment position approaches the ground electrode 50P supplied by the supply unit 240.

In the second embodiment, the surface measurement unit 220*a* measures the position of the surface 45 by moving toward the negative side of the Z axial direction. However, the present invention is not limited thereto. For example, the spark plug manufacturing apparatus may include a position measurement unit for measuring the position of the surface 45. In this case, on the basis of the position of the surface 45 measured by the position measurement unit, the surface measurement unit 220 determines, as the position of the measurement region R, a position which spaced from the position of the surface 45 by the predetermined distance L along the Z axial direction.

In the first embodiment and the third embodiment, the outwardly projecting projecting portion of the screw portion 42 and the inwardly recessed recessed portion of the screw portion 42 are used, respectively, as the reference for determination of the attachment position of the ground electrode 50P. However, the present invention is not limited thereto. For example, a predetermined position on a slanted surface which connects the outwardly projecting projecting portion of the screw portion 42 and the inwardly recessed recessed portion of the screw portion 42 may be used as a reference.

The present invention is not limited to the above-described embodiments, examples, and modifications and may be embodied in various other forms without departing from the scope of the invention. For example, the technical features in the embodiments, examples, and modifications corresponding to the technical features in the modes described in "Summary of the Invention" can be appropriately replaced or combined in order to solve some of or all the foregoing problems or to achieve some of or all the foregoing effects. A technical feature which is not described as an essential feature in the present specification may be appropriately deleted.

DESCRIPTION OF SYMBOLS

10: center electrode
20: metallic terminal
30: insulator
39: axial hole
40, 40P: metallic shell
42: screw portion
44: flange portion
45: surface
46: gasket
48: end surface
50, 50P: ground electrode
90: internal combustion engine
91: inner wall
92: combustion chamber
100: spark plug
200: manufacturing apparatus
200*a*: manufacturing apparatus
200*b*: manufacturing apparatus
210: holding, unit
20: surface measurement unit
220*a*: surface measurement unit
230: position calculation unit
240: supply unit
R: measurement region
S1. S2: slanted line segment
W: workpiece

What is claimed is:

1. A method of manufacturing a spark plug including a cylindrical tubular metallic shell having a screw portion on an outer surface of the metallic shell and a ground electrode attached to an end surface of the metallic shell located at one end in a direction of a center axis thereof, the method comprising:

a measurement step of measuring a surface of the screw portion which passes through a measurement region located at a predetermined position in the direction of the center axis, while rotating the metallic shell about the center axis of the metallic shell;

an attachment position calculation step of calculating, on the basis of information obtained in the measurement step, an attachment position at which the ground electrode is to be attached to the end surface; and a joining step of joining the ground electrode to the end surface at the attachment position, wherein the measurement step includes a step of measuring a displacement or the surface of the screw portion using a non-contact-type displacement sensor.

2. A method of manufacturing a spark plug according to claim. 1, further comprising a position determination step of determining the measurement region based on a position which is spaced from a reference position by a predetermined distance along the direct on of the center axis, the reference position being measured for the metallic shell and being used as a reference on the metallic shell.

3. A method of manufacturing a spark plug according to claim 1, wherein, in the attachment position calculation step, the attachment position is calculated by using, as a reference, a projecting portion of the surface of the screw portion passing through the measurement region, the projecting portion projecting outward as viewed from the center axis.

4. A method of manufacturing a spark plug according to claim 1, wherein, in the attachment position calculation step, the attachment position is calculated by using, as a reference, a recessed portion of the surface of the screw portion passing through measurement region, the recessed portion being recessed inward as viewed from the center axis.

5. A method of manufacturing a spark plug according to claim 2, wherein, in the attachment position calculation step, the attachment position is calculated by using, as a reference, a projecting portion of the surface of the screw portion passing through the measurement region, the projecting portion projecting outward as viewed from the center axis.

6. A method of manufacturing a spark plug according to claim 2, wherein, in the attachment position calculation step, the attachment position is calculated by using, as a reference, a recessed portion of the surface of the screw portion passing through the measurement region, the recessed portion being recessed inward as viewed from the center axis.

* * * * *